US009441382B2

(12) United States Patent
Hokanson et al.

(10) Patent No.: US 9,441,382 B2
(45) Date of Patent: Sep. 13, 2016

(54) ADJUSTABLE AIRCRAFT MAINTENANCE PLATFORM FOR IMPROVING EFFICIENCY AND SAFETY OF AIRCRAFT MAINTENANCE OPERATIONS

(71) Applicants: Clifford R. Hokanson, Kaysville, UT (US); Bill V. Anderson, Centerville, UT (US); Chase B. Parmer, Layton, UT (US)

(72) Inventors: Clifford R. Hokanson, Kaysville, UT (US); Bill V. Anderson, Centerville, UT (US); Chase B. Parmer, Layton, UT (US)

( * ) Notice: Subject to any disclaimer, the term of this patent is extended or adjusted under 35 U.S.C. 154(b) by 0 days.

(21) Appl. No.: 13/862,850

(22) Filed: Apr. 15, 2013

(65) Prior Publication Data

US 2015/0166198 A1 Jun. 18, 2015

(51) Int. Cl.

| | |
|---|---|
| ***E04G 1/15*** | (2006.01) |
| ***E04G 5/16*** | (2006.01) |
| ***E04G 5/14*** | (2006.01) |
| ***E04G 1/24*** | (2006.01) |
| ***E04G 1/36*** | (2006.01) |
| ***E04G 5/10*** | (2006.01) |
| ***E06C 1/12*** | (2006.01) |
| ***E06C 7/18*** | (2006.01) |

(52) U.S. Cl.

CPC . *E04G 5/16* (2013.01); *E04G 1/24* (2013.01); *E04G 1/36* (2013.01); *E04G 5/10* (2013.01); *E04G 5/142* (2013.01); *E06C 1/12* (2013.01); *E06C 7/182* (2013.01); *E06C 7/183* (2013.01); *E04G 2001/157* (2013.01); *E04G 2001/242* (2013.01); *Y10T 29/49718* (2015.01)

(58) Field of Classification Search

CPC ..... B64F 5/0081; E04G 2001/157; E04G 1/151; E04G 1/152; E04G 1/36; B23Q 3/062

See application file for complete search history.

(56) References Cited

U.S. PATENT DOCUMENTS

| | | | | | |
|---|---|---|---|---|---|
| 2,062,473 | A * | 12/1936 | Norton | 182/17 |
| 2,828,166 | A * | 3/1958 | Herring | 182/101 |
| 3,128,842 | A * | 4/1964 | Satrun | 182/149 |
| 3,256,955 | A * | 6/1966 | Izmirian et al. | 182/115 |
| 3,831,709 | A * | 8/1974 | Stanford et al. | 180/125 |
| 4,967,875 | A * | 11/1990 | Beeche | 182/36 |
| 5,143,173 | A * | 9/1992 | Lubinski | 182/119 |
| 5,363,940 | A * | 11/1994 | Fahrion | 182/62.5 |
| 5,375,283 | A * | 12/1994 | Silberman | 14/69.5 |
| 5,423,396 | A * | 6/1995 | Fahrion | 182/36 |
| 5,553,562 | A * | 9/1996 | Jacobs, Jr. | 114/43 |
| 8,302,736 | B1 * | 11/2012 | Olivier | 182/187 |
| 2006/0182570 | A1 * | 8/2006 | Zuercher et al. | 414/462 |
| 2008/0298942 | A1 * | 12/2008 | Gregg et al. | 414/545 |
| 2012/0056364 | A1 * | 3/2012 | DuBose et al. | 269/55 |

* cited by examiner

*Primary Examiner* — Charles A Fox
*Assistant Examiner* — Kristine Florio
(74) *Attorney, Agent, or Firm* — Steven Rinehart

(57) ABSTRACT

An apparatus and method are disclosed for servicing a vehicle, such as an airplane. The apparatus includes a mobile maintenance platform configured to position in proximity to the airplane and airplane components such as the engine and the fuselage. A cantilever deck provides a slip resistant surface to work on. A gap on the edge of the deck enables the deck to position near the airplane component. Clamps on either side of the gap apply sufficient force to stabilize the component and also serve to close the gap completely, forming a flat surface across. A railing acts as a barrier on the edge of the deck. A frame supports the deck. Adjustable legs support the frame. A jack raises and lowers the legs to regulate elevation of the deck. A tow hitch enables the apparatus to be moved. An adjustable ladder provides access to the deck.

9 Claims, 4 Drawing Sheets

ADJUSTABLE AIRCRAFT MAINTENANCE PLATFORM FOR IMPROVING EFFICIENCY AND SAFETY OF AIRCRAFT MAINTENANCE OPERATIONS

FIELD OF THE INVENTION

This invention relates to maintenance platforms, and more particularly relates to a mobile maintenance platform with features that facilitate access to airplane components.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. There exist many implements for facilitating aircraft maintenance, overhaul, repair, inspection or modification, but implements designed for many specific purposes are lacking, including implements for removing and replacing tires, inspection plates, spark plugs, checking cylinder compression, removal and replacement of fuses, light bulbs, refueling, and washing windows.

Typically, aircraft maintenance stands fall into three categories: phase maintenance stands for depot-level maintenance, daily maintenance stands, and multi-application work stands. The type of required maintenance dictates the type of work platform required, and the level of skill that a mechanic must have.

It is known in the aviation industry that aviation structural mechanics maintain aircraft airframe and structural components, flight surfaces, as well as maintaining hydraulic and pneumatic controls and actuating systems and mechanisms. The mechanics may also service landing gear systems, perform engine maintenance, air conditioning, pressurization, visual improvement, oxygen and other utility systems, egress systems, including seat and canopy ejection systems and components. Such detailed work requires facilitated access to the airplane component, which often rest at a high elevation. This work must be done in a safe efficient manner.

Mechanics need to be able to service the aircraft from a work platform reaching elevated regions of the aircraft. Suitable, safe and efficient platforms are lacking in the art. A work platform which can be configured to position in proximity to the airplane component, yet maintain a buffer to prevent bumping into the airplane component, is desirable and necessary to prevent damage to the aircraft. The work platform provides access to any tools, liquids, equipment, communication devices, and publications the mechanic may need, as well as access to the portion of the airplane which needs to be inspected and/or maintained.

In view of the foregoing, it is clear that these traditional maintenance platforms leave room for more optimal approaches.

SUMMARY

From the foregoing discussion, it should be apparent that a need exists for an apparatus and method for improving safety and efficiency of aircraft engine maintenance. Beneficially, such an apparatus and method would provide a plurality of features and components to facilitate access to aircraft, while also providing a safe, efficient working surface.

The present invention has been developed in response to the present state of the art, and in particular, in response to the problems and needs in the art that have not yet been fully solved by currently available apparatus. Accordingly, the present invention has been developed to provide an apparatus and method for servicing aircraft and vehicles that overcome many or all of the above-discussed shortcomings in the art.

The apparatus for servicing the at least one vehicle includes a plurality of modules configured to functionally execute the necessary steps of accessing vehicle components from the maintenance platform and providing a safe and adjustable working surface. In some embodiments, the apparatus comprises a mobile maintenance platform disposed to position in proximity to at least one vehicle, such as an airplane, for servicing and manufacturing. However, the present invention may also be operable to join with a stationary object for performing maintenance, including, without limitation, inspection, repairing, welding, changing parts, examining, sandblasting, and painting. The at least one vehicle may include, without limitation, an airplane, a boat, a semi-truck, an oil derrick, a drilling barge, and a hot air balloon. Those skilled in the art, in light of the present teachings, will recognize that the maintenance platform can be temporarily positioned to a desired location on the vehicle, without requiring welding, and is, thus, not subjected to the same restrictions as permanent maintenance platforms. The maintenance platform can be quickly, adjustably and removably located adjacent to any vehicle component, independent of the specific dimensions and/or structural characteristics thereof.

In one embodiment of the present invention, the apparatus includes a modular deck where a significant portion of the maintenance occurs. The deck is disposed in a substantially horizontal plane, efficacious for supporting a plurality of workers, maintenance equipment, power, work lighting, vehicle components, and accessories. The deck may be rotatable up to 360 degrees in a horizontal plane. In some embodiments, the deck may also tilt to a desired angle for further facilitating access to the at least one vehicle. The deck includes a cantilever configuration for facilitated perpendicular docking with the at least one vehicle, or vehicle component. The cantilever configuration may provide clearance for vehicle components, such as an airplane fuselage and landing gear. In one embodiment, the deck includes a coating, which may be configured to be at least partially slip resistant. The coating may include, without limitation, slip resistant diamond deck, rubber, thermally stable polyethylene terephthalate, protruding members, magnets, and adhesives. Those skilled in the art, in light of the present teachings, will recognize that vehicle maintenance often involves working with oils and small, round fasteners, thereby creating a slippery surface on the deck. Further, the maintenance platform often rises a substantial distance over the ground surface, whereby slipping and falling off the maintenance platform can cause serious personnel injury or tool damage. The deck may comprise adjustable, telescopic, slidable and/or removable platform components for adjusting the size and shape of the deck for specific purposes. In some embodiments, a detachable or fixed railing is disposed to form a safety barrier around a peripheral edge of the deck. The railing may telescopically extend and retract, vertically or horizontally, to a desired size and dimension, for the purpose of safety and fall protection. The railing includes hand grips to allow a worker to grasp while servicing the at least one vehicle. The railing may also include storage compartments for holding tools and parts pertinent to servicing the at least one vehicle. The railing may detach completely from the deck when not in use, or during transport. In other embodiments, the railing may extend and retract from the deck or the side of the deck. The railing may locked in a desired position using a fastener. An adjustable extension leg may join with the railing, allowing access from a ground surface to the deck. The adjustable extension leg may comprise a ladder ship's ladder, staircase, escalator or elevator that is configured to provide access to the deck. In those embodiments comprising ladders or staircases, spacing between the steps or stairs is maintained evenly as the extension leg is adjusted. In some embodiments, the deck includes an integrally formed at least one gap on at least one edge of the deck. The at least one gap provides a space for encompassing a vehicle component, whereby the maintenance platform may move closer to the vehicle component. The vehicle component may include, without limitation, an airplane engine, a wing, a support frame, landing gear, and a building. One or more sliding platforms are positioned on either side of the at least one gap. The sliding platform(s) are configured to adjustable slide into position adjacent to an aircraft engine or fuselage. The sliding platforms slide in plane with the deck, forming a substantially planar surface extendable and retractable to augment or mitigate the size of the at least one gap.

In a further embodiment, the apparatus includes a modular frame. The frame provides a lightweight structure that joins beneath the deck for support. The frame may comprise a plurality of tensile and compression support members, such as bars, rods, angles, beams, channels and tubes. In some embodiments, the frame may be configured to provide different amounts of support members so as to adjustably change in size, shape, and dimension. The modular configuration of the frame allows for easy construction or flexible arrangement. A plurality of fasteners secures the plurality of support members into a desired size, shape, and dimension. The plurality of fasteners may include, without limitation, quick connect t-pins, latches, rivets, screws, bolts, adhesives, and magnets. Suitable materials for fabricating the frame may include, without limitation, aluminum, steel, metal alloys, fiberglass, and high density polymers. In some embodiments, the frame may include a transport portion for moving the maintenance platform. The transport portion may include, without limitation, casters, rubber wheels, rails, and tracks. The transport portion may be adjustably lowered for engaging the ground surface, and raised for storage. In yet another embodiment, a tow portion may join with the frame. The tow portion may include a coupling configured to join with a tow member for pulling and/or pushing the maintenance platform. The towing portion may include, without limitation, a tow hitch, a clevis pin, a lunette ring, and a triangle hitch, or other hitches known to those of skill in the art. The tow portion and the transport portion may provide a synergy for efficient transportation and positioning of the maintenance platform in proximity to the at least one vehicle.

In one embodiment of the present invention, the apparatus includes at least one leg. Each leg extends in a substantially vertical orientation from the ground surface. The at least one leg may telescopically adjust for elevating to a desired height for servicing the at least one vehicle, positioning around a vehicle component, and/or allowing the transport portion to engage the ground surface. In one embodiment, the maintenance platform may elevate up to thirty inches. An adjustable hand crank powers the elevation of the deck. However, in other embodiments, the elevation may be automatic. However, greater heights may be achieved in additional embodiments. At least one jack may lift and lower the maintenance platform to a desired height. Those skilled in the art, in light of the present teachings, will recognize that the deck, the maintenance workers, the vehicle components, the tools on the deck, and the frame may combine to form a heavy load. The at least one jack is efficacious in applying sufficient force to support and elevate the heavy load. The at least one jack may include, without limitation, a five ton screw jack, a pneumatic jack, or a hydraulic jack. A jack connection bar may join a pair of the jacks to provide a multiplier effect when the pair of jacks lifts very heavy loads. The jack connection bar may be removed to allow the maintenance platform to position closer to the at least one vehicle. In some embodiments, each leg includes a foot for engaging and anchoring into the ground surface. The foot may provide an expanded surface area for additional stability.

A method of the present invention is also presented for servicing at least one vehicle from a maintenance platform. The method in the disclosed embodiments substantially includes the steps necessary to carry out the functions presented above with respect to the operation of the described apparatus. In one embodiment, the method includes lowering a transport portion to engage a ground surface. The transport portion may include a plurality of heavy-duty casters, which include a plurality of brakes and/or a plurality of swivel locks. The hand crank is operable to operate the at least one jack, which when lowered, allows the transport portion to engage the surface.

In a further embodiment, the method includes joining a tow portion with a force that pulls and/or pushes the maintenance platform. The tow portion may include a tow hitch for joining with a tow line. A towing vehicle may join with an opposite end of the tow line to pull or push the apparatus. Those skilled in the art, in light of the present teachings, will recognize that the tow portion may serve as a buffer, preventing the frame from damage while engaging the tow vehicle.

The tow member 118 may comprise a tow line, tow bar, hitch, rope, cable or the like.

In one embodiment, the method includes positioning the deck in proximity to the at least one vehicle. The deck may move sufficiently near the vehicle for facilitating service capabilities, yet maintain a sufficient buffer to avoid contact with the vehicle. In this manner, damage to the vehicle or the vehicle components may be avoided.

In a further embodiment, the method includes manipulating a hand crank to operate the at least one jack. In yet other embodiments, the crank may be automated. In one embodiment, the method includes elevating the deck. The at least one jack may elevate the deck thirty inches. However, in other embodiments, the deck may be elevated to a higher elevation.

In a further embodiment, the method includes encompassing a vehicle component with a sliding platform. The sliding platforms position on either side of the at least one gap in the deck. The sliding platforms are configured to removably engage the vehicle component. The sliding platforms may be configured to hold or secure the vehicle component to prevent movement through the application of inward pressure, though they are not so configured as shown. The sliding platforms form an integral flat surface with the deck to close the at least one gap.

In one embodiment, the method includes extending a railing around a peripheral edge of the deck. The railing, in one embodiment, includes a lightweight, aluminum railing that helps enhance the safety while servicing the vehicle. Other embodiments comprises railing fabricated from steel, carbon fiber, and other materials known to those of skill in the art. In this manner, compliance may be achieved with regulations of various regulatory authorities such as OSHA. The railing may include a toe stop to secure the railing in an upright position, or a planar position for storage or transport. In a further embodiment, the method includes extending an adjustable leg extension from a ground surface to the deck. The adjustable leg extension may include a ladder for accessing the deck. In one embodiment, the method includes servicing the at least one vehicle from the deck. In one embodiment, the slip resistant coating on the deck enhances safety while servicing the at least one vehicle. In other embodiments, the deck comprises gratings and other smooth surfaces. Further, the railing may include storage sites for holding tools, equipment, hoses, and manuals.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Additionally, the order in which a particular method occurs may or may not strictly adhere to the order of the corresponding steps shown.

Figure 1:
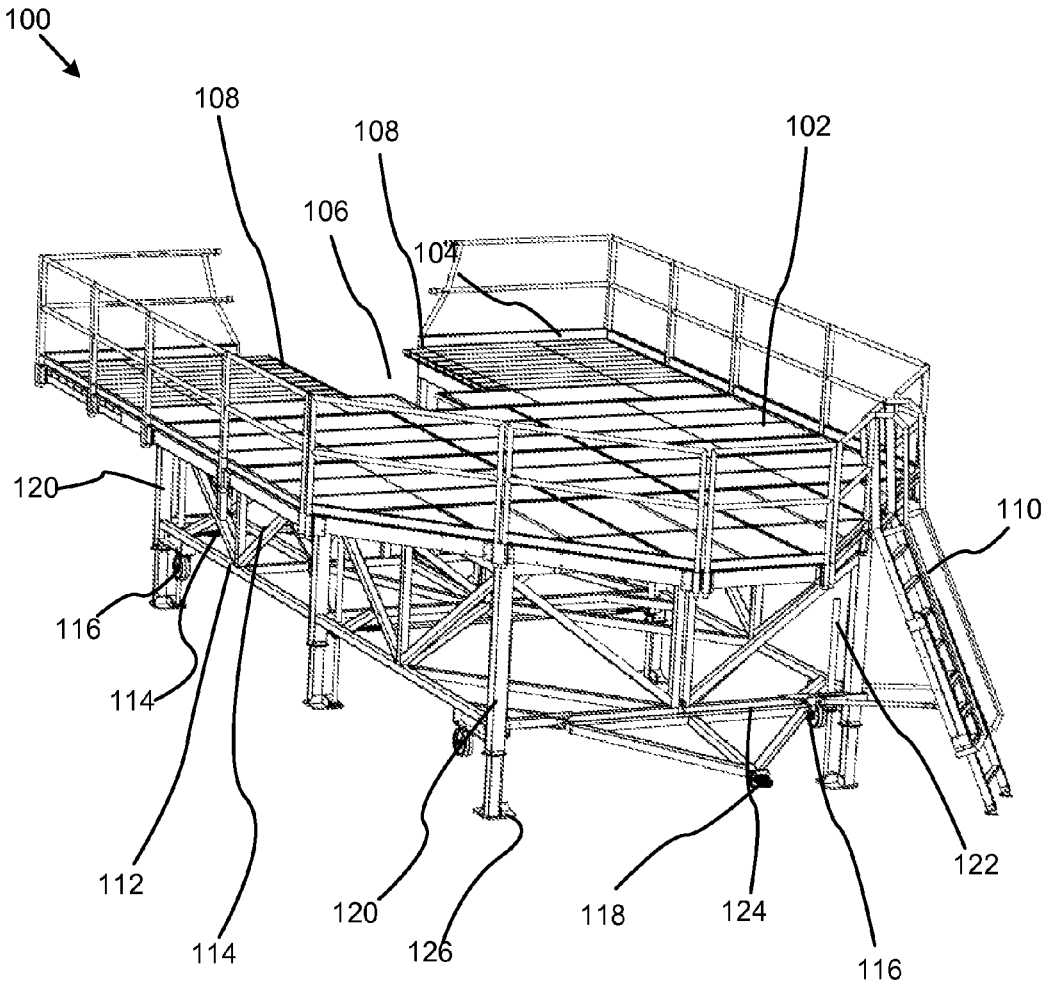
FIG. 1 is an upper perspective view of one embodiment of a maintenance platform in accordance with the present invention.

FIG. 1 depicts the apparatus in accordance with the present invention. In the present invention, an apparatus 100 comprises a mobile maintenance platform disposed to position in proximity to at least one vehicle for servicing and manufacturing. The maintenance platform provides a safe, efficient, adjustable surface for accessing at least one vehicle or vehicle component. Numerous features allow the maintenance platform to be especially efficacious for servicing an aircraft. However, the at least one vehicle may further include, without limitation, an airplane, a boat, a semi-truck, an oil derrick, a drilling barge, and a hot air balloon. In other embodiments, the maintenance platform may be operable to join with a stationary object for performing maintenance, including, without limitation, welding, inspection, changing parts, examining, sandblasting, and painting.

In one embodiment of the present invention, the apparatus includes a deck 102 where a significant portion of the operator maintenance occurs. The deck 102 is disposed in a substantially horizontal plane, efficacious for supporting a plurality of workers, maintenance equipment, and vehicle components. The deck 102 may be rotatable up to 360 degrees in a horizontal plane. In some embodiments, the deck 102 may also tilt hydraulically to a desired angle for further facilitating access to the at least one vehicle. In some embodiments, a detachable railing 104 is disposed to form a safety barrier around a peripheral edge of the deck 102. The railing 104 may telescopically extended, vertically or horizontally, and retract to a desired size and dimension.

In various embodiments of the present invention, the railing 104 has rubber end caps. The railing 104 may be telescopic both vertically and horizontally, locking in some embodiments in place with pins. The railing 104 includes hand grips to allow a worker/operator to grasp while servicing the at least one vehicle or aircraft. The railing 104 may also include storage compartments or fixtures, for holding tools, accessories, reference materials, and/or parts pertinent to servicing the at least one vehicle, including lights and utility cables. The railing 104 may detach completely from the deck 102 when not in use, or during transport. In other embodiments, the railing 104 may extend and retract from the deck 102 or the side of the deck 102. The railing may be locked into a desired position using fasteners known to those of skill in the art. In one alternative embodiment, the railing 104 may include illumination as a further safety feature.

The deck 102 may comprise removable and affixed plates, some having mounts for various apparati.

In a further embodiment, the deck 102 includes at least one gap 106 on at least one edge of the deck 102. The at least one gap 106 is integrally joined with the deck 102, and provides a space for encompassing a vehicle component. In this manner, the maintenance platform 100 may position in proximity to the vehicle component. The vehicle component may include, without limitation, an airplane engine, a wing, a support frame, landing gear, and a building. A sliding platform 108 positions on either side of the at least one gap 106. The sliding platform 108 is configured to removably engage a vehicle component, such as an engine, fuselage, or landing gear. The sliding platform 108 extends into position near or against a vehicle components, sliding along a planar surface bridging a portion of the gap. The sliding platform 108 is operable to move between an open and closed position over the gap, adjustable to facilitate safe and efficient access to variously sized vehicle components. In this manner, the sliding platform 108 functions to form an integral flat surface with the deck to close the at least one gap. An adjustable extension leg 110 may join with the railing, extending from the ground surface to the deck. The adjustable extension leg 110 may comprise a ladder that is configured to provide access to the deck.

The apparatus 100, 300, 400 may comprise a clamp to hold or secure the apparatus to an inlet inspection stand.

In a further embodiment, the apparatus 100 includes a frame 112 that provides structural integrity. The frame 112 is modular, in that reconfiguration into different sizes, shapes, and dimensions is possible, depending on the at least one vehicle and the vehicle component to be serviced. The modular configuration of the frame 112 allows for easy construction, transport, assembly, disassembly or flexible arrangement. The frame 112 provides a lightweight structure that joins beneath the deck 102 for support. The frame 112 may comprise a plurality of support members 114, such as bars, rods, angles, tubes, channels, beams, and compression and tensile members. In some embodiments, the frame 112 may be configured to provide different amounts of support members 114 so as to adjustably change in size, shape, and dimension. A plurality of fasteners secures the plurality of support members 114 into a desired size, shape, and dimension. The plurality of fasteners may include, without limitation, quick connect t-pins, latches, rivets, screws, bolts, adhesives, and magnets. Suitable materials for fabricating the frame 112 may include, without limitation, aluminum, steel, metal alloys, fiberglass, and high density polymers. In some embodiments, the frame 112 may include a transport portion 116 for moving and repositioning the maintenance platform 100. The transport portion may include, without limitation, casters. The transport may additionally or alternatively comprise brakes, rubber wheels, rails, and tracks. The transport portion may be adjustably lowered for engaging the ground surface, and raised for storage. In yet another embodiment, a tow portion 118 may join with the frame. The tow portion 118 may include a coupling configured to join with a tow member for pulling and/or pushing the maintenance platform. The tow portion 118 may include, without limitation, a tow hitch, a clevis pin, a lunette ring, and a triangle hitch, or other hitches known to those of skill in the art. The tow portion 118 and the transport portion may provide a synergy for efficient transportation and positioning of the maintenance platform in proximity to the at least one vehicle.

In one embodiment of the present invention, the apparatus includes at least one leg 120. Each leg 120 extends in a substantially vertical orientation from the ground surface, or from a foot 126. The leg 120 may comprise a hollow sleeve for receiving the foot 126. The at least one leg 120 may telescopically adjust for elevating to a desired height for servicing the at least one vehicle, positioning around a vehicle component, and/or allowing the transport portion to engage the ground surface. In one embodiment, the maintenance platform 100 may elevate up to thirty inches. An adjustable hand crank powers the elevation of the deck. However, in other embodiments, the elevation may be automatic, pneumatic, mechanical, electromechanical, and/or hydraulically-effectuated. Heights greater than thirty inches may be achieved in additional embodiments. At least one jack 122 may lift and lower the maintenance platform 100 to a desired height. Those skilled in the art, in light of the present teachings, will recognize that the deck 102, the maintenance workers, the vehicle components, the tools on the deck 102, and the frame 112 may combine to form a heavy load. The at least one jack 122 is efficacious in applying sufficient force to support and elevate the heavy load. The at least one jack 122 may include, without limitation, a five ton screw jack, a pneumatic jack, and a hydraulic jack. A jack connection bar 124 may join a pair of the jacks 122 to provide a multiplier effect when the pair of jacks lifts very heavy loads. Jack connection bars 124 may interjoin multiple jacks 122, up to and including all the jacks 122 forming the bench 100. The jack connection bar 124 may be removed to allow the maintenance platform 100 to position closer to the at least one vehicle.

In some embodiments, each leg includes a foot 126 for engaging and anchoring into the ground surface. The foot 126 may provide an expanded surface area for additional stability. The foot 126 may comprise an upwardly extending member having measuring identifiers for identifying the height of the deck platform 100.

The apparatus 100 may further comprises a desk, work bench, or laptop station detachably affixable in place around the railing 104.

Figure 2:
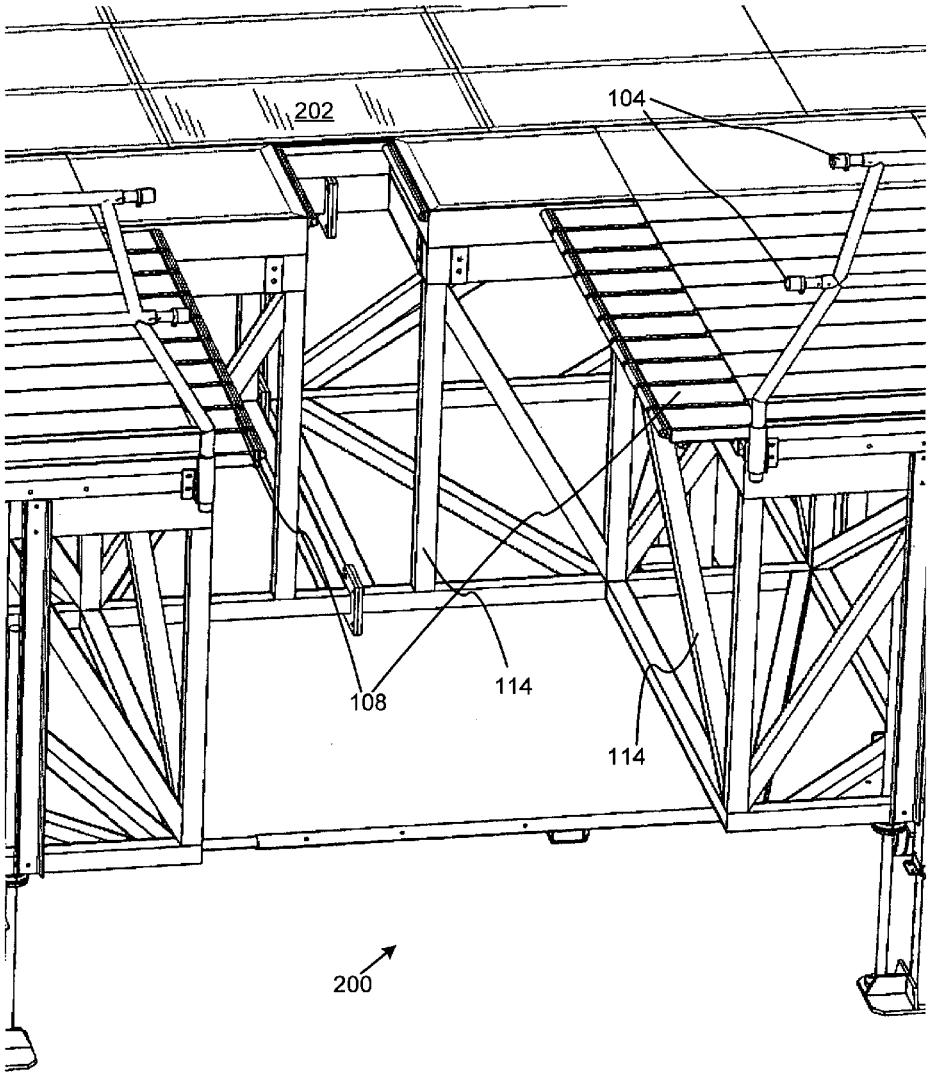
FIG. 2 is an exploded perspective view illustrating one embodiment of a deck of a maintenance platform in accordance with the present invention.

FIG. 2 depicts a maintenance platform 200 in accordance with the present invention. In the present invention, the apparatus includes a modular deck where a significant portion of the maintenance occurs. The maintenance platform 200 includes a cantilever configuration for facilitated perpendicular docking with the at least one vehicle or vehicle component. The cantilever configuration may provide clearance for vehicle components, such as an airplane engine, fuselage and landing gear. In one embodiment, the maintenance platform 200 includes a coating 202, which may be configured to be at least partially slip resistant. The coating 202 may include, without limitation, slip resistant diamond deck, rubber, thermally stable polyethylene terephthalate, protruding members, magnets, and adhesives. Those skilled in the art, in light of the present teachings, will recognize that vehicle maintenance often involves working with oils and small, round fasteners, thereby creating a slippery surface on the deck. Further, the maintenance platform 100 often rises a substantial distance over the ground surface, whereby slipping and falling off the maintenance platform can cause serious personnel injury or tool damage.

Figure 3:
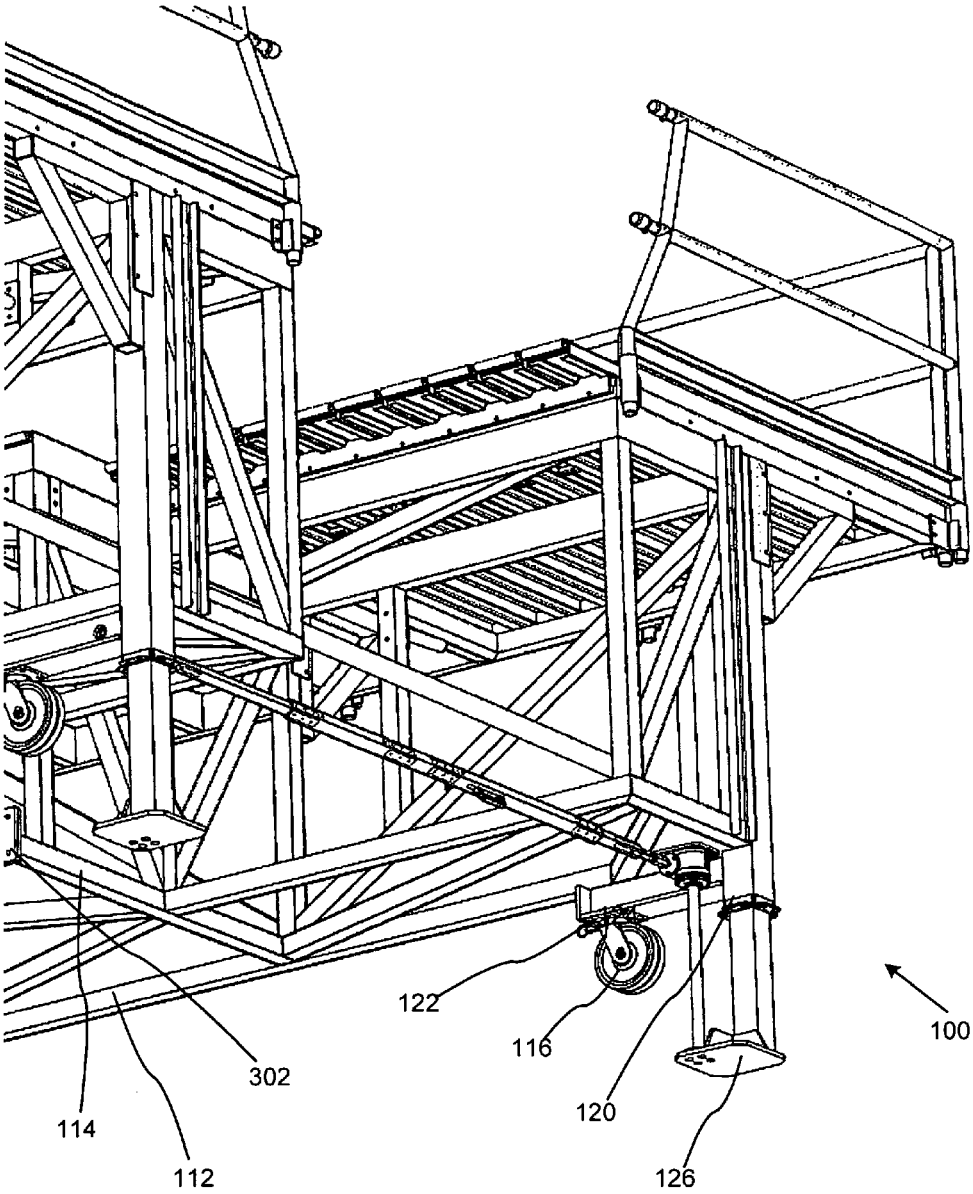
FIG. 3 is a lower perspective view illustrating one embodiment of at least one leg of a maintenance platform in accordance with the present invention.

FIG. 3 depicts at least one leg in accordance with the present invention. In the present invention, the apparatus 100 includes at least one leg 120. The at least one leg 120 telescopically extends and retracts to vary the elevation of the deck 102. In one embodiment, the at least one leg 120 may include four legs positioned at equidistant corners of the frame 112. The legs 120 may be secured to the frame 112 with a plurality of fasteners 302, welded joints, and the like known to those of skill in the art. The plurality of fasteners 302 may also serve to join the plurality of support members. The plurality of fasteners 302 may include, without limitation, quick connect t-pins, latches, rivets, screws, bolts, adhesives, and magnets.

Figure 4:
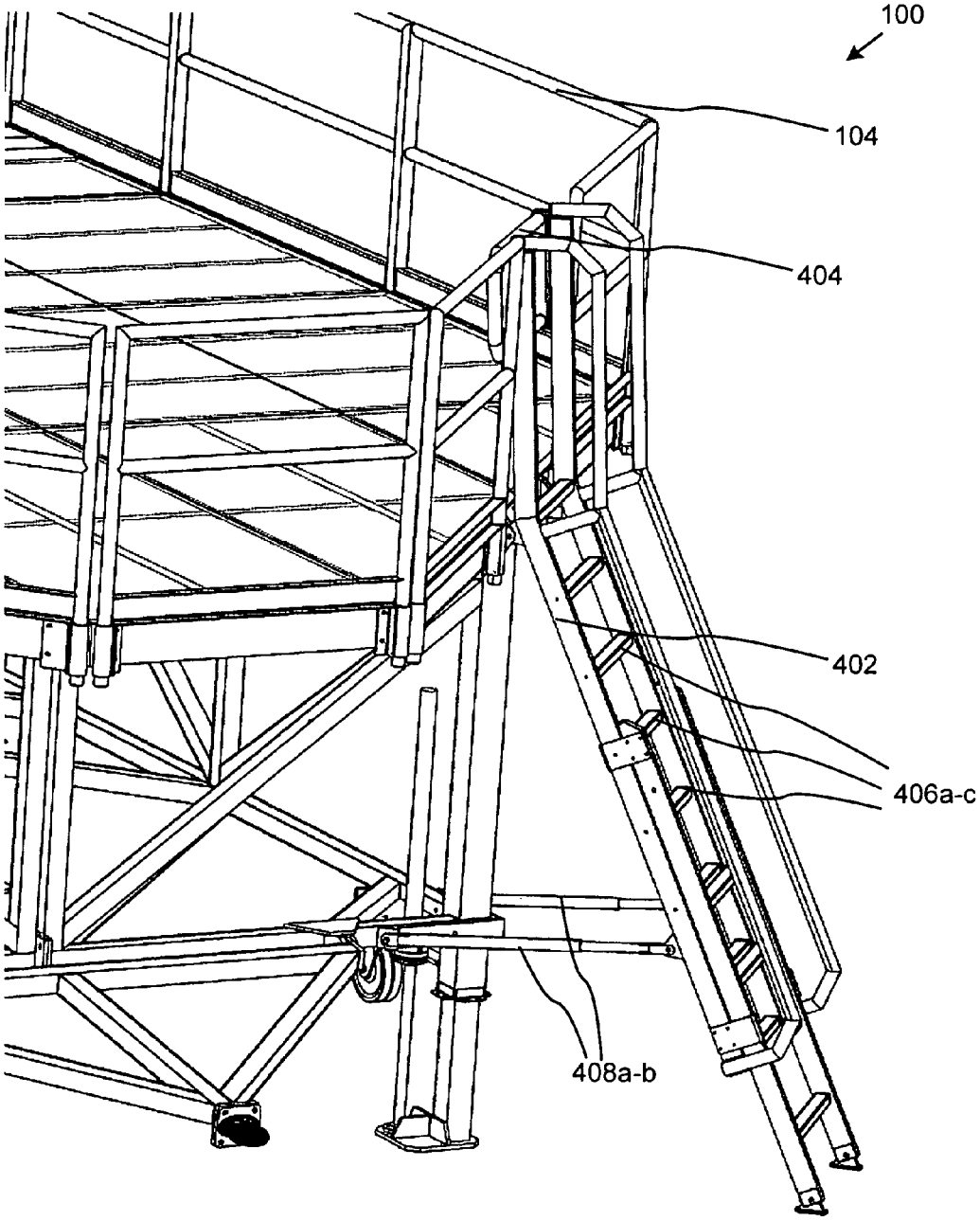
FIG. 4 is an upper perspective view illustrating one embodiment of a ship's ladder assembly affixed to the maintenance platform in accordance with the present invention.

FIG. 4 is an upper perspective view illustrating one embodiment of a ship's ladder assembly 400 affixed to the maintenance platform in accordance with the present invention. The ladder assembly 400 comprises a ladder 402, a spring-loaded safety gate 404, steps 406, and kick outs 408.

The ladder 402 comprises a ship's ladder, having an angle of incline of between zero and forty-five degrees off vertical. In other embodiments, the ladder 402 may comprise a ladder (having an angle of incline of zero degrees), a staircase (having an angle of incline of more than 45 degrees), an elevator, an escalator, or any other lifting device known to those of skill in the art.

The ladder 402 is uniquely configured to provide a safe and efficient workable access the lifting platform 100 which is mobile and complies the regulations or pertinent regulating authorities, including, but not limited to, OSHA.

The ladder assembly 400 comprises a safety gate 404 which includes a gate hingedly affixed to the ladder 402 handrails and/or the railing 104, which gate 404 is spring-biased in the closed position.

The ladder 402 comprises a plurality of steps 406 configured to remain spaced apart uniformly when the ladder 402 is adjusted or extruded using a track system, telescoping members, or via other means known to those of skill in the art.

In various embodiments of the present invention, the ladder 402 may engage a ground surface or may stay suspending above it to reduce drag during transport.

The kick outs 408 secure the ladder 402 at an inclined position, and are telescopically adjustable. The ladder assembly 400 may comprise one or a plurality of kick outs 408.

The ladder 402 is also hingedly or pivotably affixed to the apparatus 100. The ship's ladder 402 may be raised and lowered with a hand ratchet or via other means known to those of skill in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An adjustable portable maintenance apparatus platform for providing maintenance to at least one vehicle, the maintenance platform comprising:

a deck, the deck being configured to form a planar surface, the deck comprising at least one gap, the at least one gap being configured to at least partially enable the deck to position in proximity to a vehicle component to at least partially encompass the vehicle component, the deck further comprising a coating, the coating being operable to provide a slip resistant surface, the deck further comprising a detachable railing, the railing being disposed to position around a peripheral edge of the deck;

two or more sliding platforms disposed below the deck for extruding in plane with the deck across the gap to reduce a size of the gap, the platforms disposed in parallel at opposing sides of the gap;

a frame, the frame being configured to support the deck, the frame comprising a plurality of support members, each support member being configured to join together to form a pattern that comprises the frame, the frame further comprising six or more jacks, each jack being operable to apply a force to raise and lower the deck, the frame further comprising a tow portion, the tow portion being configured to enable pushing and pulling of the apparatus;

a transport portion, the transport portion being configured to enable movement of the apparatus;

six or more legs each leg being configured to support the frame, each leg comprising a distal end, the distal end being disposed to join with the frame, each leg being operable to telescopically raise and lower, each leg further comprising a proximal end, each leg comprising a foot, the foot being disposed to join with the proximal end, the foot being configured to engage a ground surface; and an adjustable extension leg, the adjustable extension leg being disposed to extend between the ground surface and the deck.

2. The apparatus of claim 1, wherein the apparatus comprises an airplane maintenance platform.

3. The apparatus of claim 1, wherein the sliding platform(s) are operable to extend the deck to within three inches of the vehicle component.

4. The apparatus of claim 1, wherein the coating comprises a slip resistant diamond deck.

5. The apparatus of claim 1, wherein the plurality of support members comprise a plurality of fasteners, the plurality of fasteners comprising a plurality of quick connect t-pins and a plurality of latches.

6. The apparatus of claim 1, wherein the transport portion comprises a plurality of heavy-duty casters, the plurality of heavy-duty casters comprising a plurality of brakes and a plurality of swivel locks.

7. The apparatus of claim 1, wherein the railing comprises aluminum hand rails.

8. The apparatus of claim 1, wherein the jacks are operable to elevate the apparatus about thirty inches.

9. The apparatus of claim 1, wherein the adjustable extension leg comprises a ship's ladder having two or more kick outs for securing the ladder at an inclined position.

* * * * *